US009717968B2

(12) United States Patent
Olsen

(10) Patent No.: US 9,717,968 B2
(45) Date of Patent: Aug. 1, 2017

(54) ICE HOCKEY PRACTICE TARGET

(71) Applicant: Rodney Olsen, Vergennes, VT (US)

(72) Inventor: Rodney Olsen, Vergennes, VT (US)

( * ) Notice: Subject to any disclaimer, the term of this patent is extended or adjusted under 35 U.S.C. 154(b) by 0 days.

(21) Appl. No.: 14/147,544

(22) Filed: Jan. 5, 2014

(65) Prior Publication Data

US 2015/0190700 A1 Jul. 9, 2015

(51) Int. Cl.

*A63B 69/00* (2006.01)
*A63B 63/00* (2006.01)
*A63B 71/06* (2006.01)

(52) U.S. Cl.

CPC .... *A63B 69/0026* (2013.01); *A63B 2063/002* (2013.01); *A63B 2071/0625* (2013.01); *A63B 2209/02* (2013.01); *A63B 2210/50* (2013.01)

(58) Field of Classification Search

CPC ... A63B 63/004; A63B 63/00; A63B 69/0026; A63B 2069/0008
USPC ..... 473/446, 478, 417; 273/398–402
See application file for complete search history.

(56) References Cited

U.S. PATENT DOCUMENTS 3,840,228 A * 10/1974 Greaney ..... A63B 63/00 273/127 B
3,979,120 A * 9/1976 Dietrich ..... A63B 63/004 403/229
4,886,267 A * 12/1989 Licciardi ..... A63B 69/0075 473/417
5,004,234 A * 4/1991 Hollis ..... A63B 69/0075 473/417
5,346,227 A * 9/1994 Amram ..... A63B 63/004 273/400
5,934,679 A * 8/1999 Strain ..... A63B 51/04 273/127 C
6,264,572 B1 * 7/2001 Matheson ..... A63B 69/0026 273/402
6,508,729 B1 * 1/2003 Coltrane ..... A63B 63/00 273/402
7,244,199 B1 * 7/2007 Romano ..... A63B 71/022 273/127 R
7,578,757 B1 * 8/2009 McNary ..... A63B 69/0053 273/400
2005/0255945 A1 * 11/2005 Green ..... A63B 69/0002 473/417
2012/0258822 A1 * 10/2012 Harvey ..... A63B 69/0002 473/417
2014/0045628 A1 * 2/2014 Krohl ..... A63B 63/00 473/446
2014/0200101 A1 * 7/2014 Toombs ..... A63B 69/0002 473/417

* cited by examiner

*Primary Examiner* — Mark Graham
(74) *Attorney, Agent, or Firm* — Finch & Maloney PLLC

(57) ABSTRACT

An ice hockey practice target is provided, the target comprising a first substantially tubular portion, including a first end attached to a base and a second end constructed and arranged to engage an upper horizontal goal crossbar, and a second tubular portion attached to the base, the second tubular portion constructed and arranged to engage and secure a lower end of a vertical goal post.

15 Claims, 12 Drawing Sheets

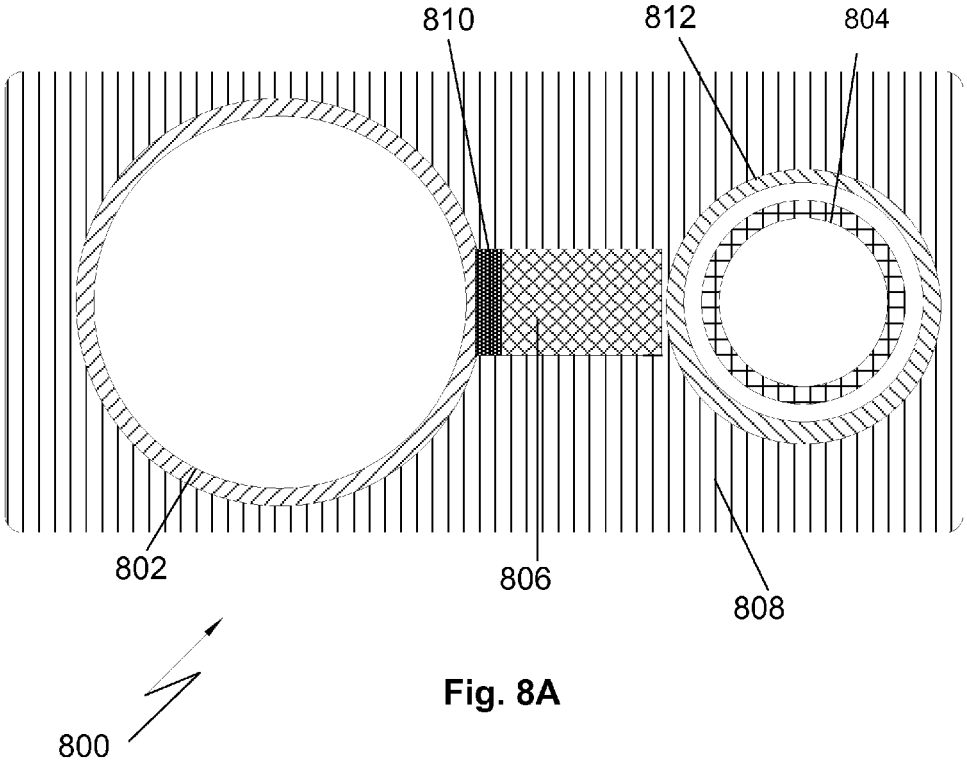
Fig. 8A
Fig. 8B
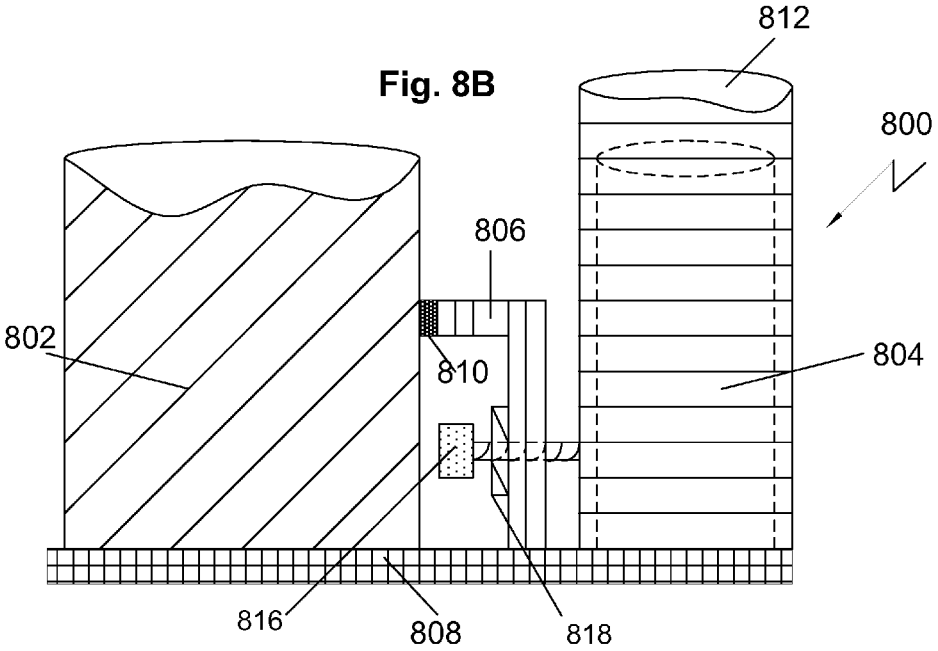

ICE HOCKEY PRACTICE TARGET

BACKGROUND

Field of Invention

The disclosure relates generally to the field of sports in which a netted goal is used for scoring, and more specifically, to the sport of ice hockey.

Discussion of Related Art

Ice hockey, and other like sports, is a competitive game in which an object such as a puck is shot through the opening of a netted goal. Because the goal is defended, the ability to control the accuracy and speed of the shot are valuable skills for an offensive player. Therefore, the ability to master these skills during training can improve the player's game performance, resulting in more goals. Players can practice these skills with targets placed in the upper and lower corners of the goal opening or with inserts which fit within the goal opening, manufactured with strategically placed holes/slots or in the form of a goalie.

SUMMARY OF INVENTION

The subject matter of this application may involve, in some cases, interrelated products, alternative solutions to a particular problem, and/or a plurality of different uses of a single system or article.

In one aspect, an ice hockey practice target is provided, the target comprising a first substantially tubular portion, including a first end attached to a base and a second end constructed and arranged to engage an upper horizontal goal crossbar, and a second tubular portion attached to the base, the second tubular portion constructed and arranged to engage and secure a lower end of a vertical goal post. The first substantially tubular portion can further comprise a yoke shaped cap enclosing the second end. The base may further comprise a brace attached to the base by which the first substantially tubular portion is held in a perpendicular position relative to the base. The base may be comprised of a substantially planar plate configured to accommodate the first substantially tubular portion and the second tubular portion. The first substantially tubular portion may be secured to the upper horizontal goal crossbar by a clamp. The outer diameter of the first substantially tubular portion may be about 1" to 4" and the inner diameter of the portion may be about 2⅜" to 3". The first substantially tubular portion may be made of a material that produces a tone when struck such as, for example, steel, aluminum, stainless steel, fiberglass reinforced plastic or polycarbonate. The first substantially tubular portion may be configured to have either a continuous or a varying outer diameter along its length. The first substantially tubular portion can be of a single piece or can be comprised of at least two segments which may be different shapes. Each of the different segments can be composed of a different material such as, for example, steel, aluminum, stainless steel, fiberglass reinforced plastic or polycarbonate. The different segments can be graduated in diameter such that one segment fits inside another, allowing the segments to telescope. The telescoping segments can be secured in their extended position by, for example, set screws or pins threaded through two different nesting segments. At least one of the segments may be a dampening band creating at least two different tones when the target is struck in different locations. The first substantially tubular portion may be hollow and may be configured to have a varying or a continuous inner diameter along its length. The first substantially tubular portion can be solid or filled with a second material such as sand, foam or water for example. The base may be affixed permanently to the first substantially tubular portion or may be detachable, wherein a flange can be used to secure the base to the first substantially tubular portion. The second tubular portion may have an inner diameter of about 2⅜ " to 3" and an outer diameter of about 1" to 4". The second tubular portion may be cone shaped. A third tubular portion may be configured to fit over the first substantially tubular portion such that the third tubular portion moves freely along the outer surface of the first substantially tubular portion, the inner diameter of the third tubular portion being between about 2⅜" to 3". The third tubular portion may be held in place by set screws or pins, for example, and may be composed of steel, aluminum, stainless steel, fiberglass reinforced plastic or polycarbonate, for example.

In another aspect, an ice hockey practice target is provided, the target comprising a base constructed and arranged to sit on an ice surface, a first substantially tubular portion comprised of a first end, constructed and arranged to attach to the base so that the base stabilizes the first end at about a ninety degree angle relative to the surface of the ice and vertically within the hockey goal opening, and a second end, constructed and arranged to engage an upper horizontal goal crossbar so that the crossbar stabilizes the second end at about a ninety degree angle relative to the cross bar and vertically within the hockey goal opening.

In another aspect, a method of using a target is provided, the method comprising placing the target on an ice surface, engaging the ice hockey practice target to an upper horizontal goal crossbar, engaging the ice hockey practice target with a vertical goal post, shooting a puck at the ice hockey practice target and listening for a sound indicating that the puck successfully struck the ice hockey practice target.

BRIEF DESCRIPTION OF DRAWINGS

In the drawings:

FIGS. 8A and 8B provide a top view and a plan view of a base of the practice target of FIG. 4, respectively;

DETAILED DESCRIPTION

The ability to control the accuracy and speed of the shot are valuable skills for an ice hockey player, as well as in other goal sports such as soccer and lacrosse. An effective training tool can be important for the development of these skills in players of all ages and experience. As disclosed herein, a target can be placed parallel to the inside of a vertical goal posts, the optimal target area for making a goal, and when hit, the target gives an auditory indication that the player has placed his shot within the desired area of the goal and with enough force to score. In various embodiments, the target is portable, easy to attach to the goal posts, does not require electricity, affords target stability, can be sold singularly or in pairs, and covers the area of the goal opening in which scoring is most likely. Moreover, with the shot velocity of a hockey puck ranging from 80 to 100 mph, the stability of the target allows it to withstand the force produced by the shot, eliminating the need for the player to reset the target after striking it.

It is believed that when practicing without a goalie, players often aim at one of the goal posts to gain positive feedback through the noise that the puck makes impacting the goal posts. This auditory sound informs the player, his or her teammates and spectators that the difficult shot was well placed. However, because the player is self-trained to hit the goal posts and not the area immediately inside the posts, muscle memory and mental conditioning unintentionally lead the player to shoot for the goal posts while competing, thus causing the shot to miss the goal and hit the post more often than would randomly occur otherwise. To become a more skilled player, the player needs to "unlearn" this habit of shooting for the goal posts and instead learn a new habit of shooting for the area immediately inside the goal posts. Therefore, a more effective training technique would be to train the player to actually shoot for the goal opening itself so that muscle memory and mental conditioning afford more scoring opportunities. Previous inventions that attempt to resolve this issue have lacked features that would allow, for example, for maximum training effectiveness or for easy use. Many of these training apparatuses involve a solid board that either covers the goal opening partially or entirely. Those that cover the goal opening in its entirety typically do not have holes that cover the preferred shot area in its entirety. Still others are attached to the goal posts and cover only a small portion of the preferred shot area.

Figure 11:
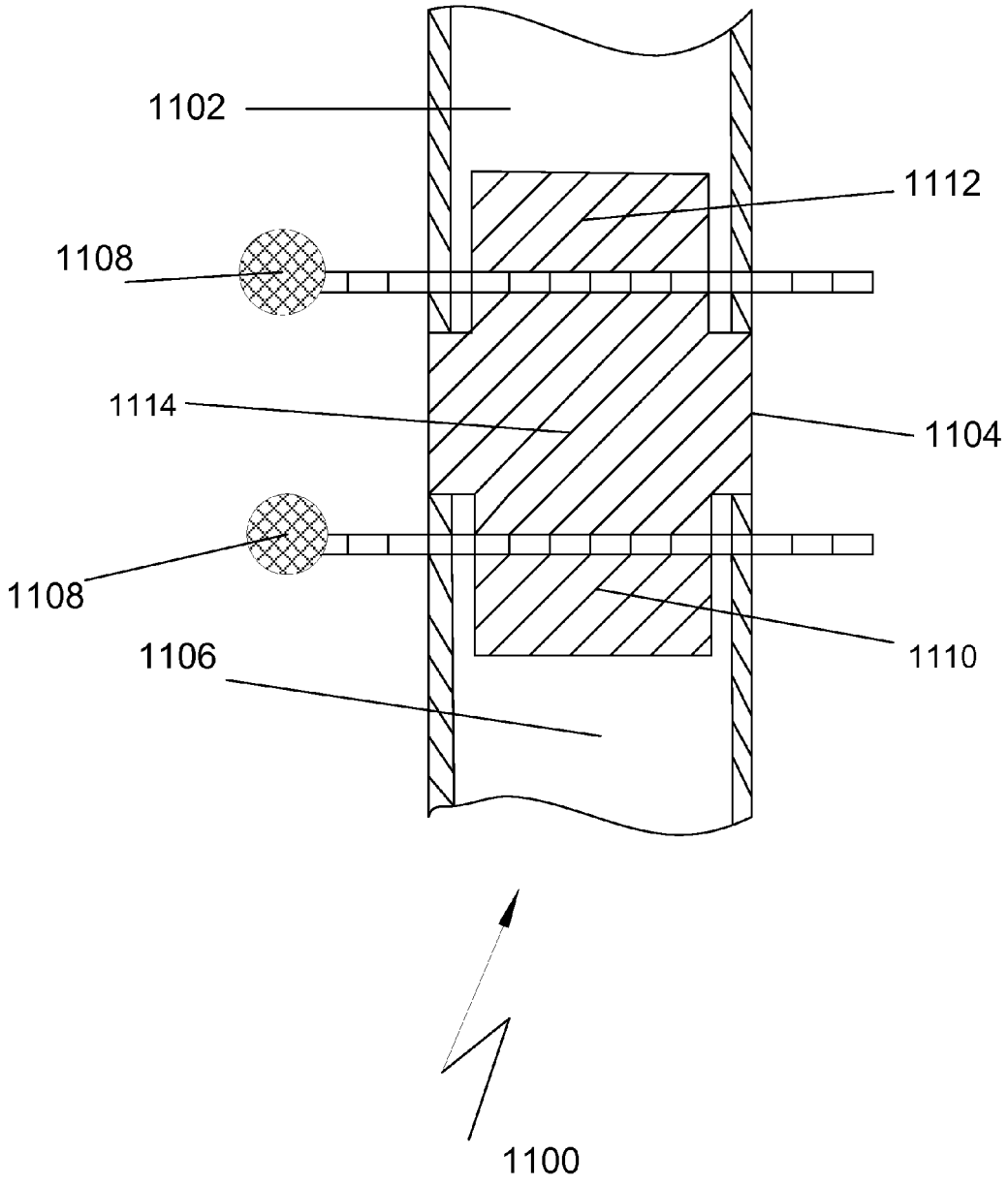
FIG. 11 provides a cross section view of an embodiment of an ice hockey practice target in which sound damping sections are placed between different sections of the target.

The ice hockey practice target may comprise a first substantially tubular portion, having a first end and a second end, and a base. The ice hockey target can fit within the opening of an official sized hockey goal, which measures 48" from the surface of the ice to the bottom of the upper horizontal goal crossbar and which measures 72" inches across. The target is of a length so that it is configured not to lift the goal off the ice surface but not so short as to become unstable inside the goal opening. In many embodiments, the downward pressure exerted by the upper horizontal goal crossbar on the first substantially tubular portion and the upward pressure exerted by the ice surface on the base, provide the needed vertical force to place the target in compression and stabilize the first substantially tubular portion and the base within the opening of the goal. The first substantially tubular portion may be made of a material that creates an audible sound when hit by a rubber hockey puck that indicates to the player that his shot has hit the target. The first substantially tubular portion may be a single segment or divided into two or more segments of different shapes and materials. The first substantially tubular portion may be a solid tube, a hollow tube or a tube filled with a second material such as sand, foam or water to vary the weight and acoustical properties of the first substantially tubular portion. The second end may be constructed and arranged to engage an upper cylindrical horizontal crossbar and may be covered in a protective coating. The second end may be secured to the upper horizontal goal crossbar with a clamp or other binding device. The first and second end may be open or closed by a cap. The first end may be constructed and arranged to attach to a base. The base may be of a similar or dissimilar material as the first substantially tubular portion. The base can comprise a substantially planar plate which is configured and arranged to accommodate the first substantially tubular portion, a second tubular portion and an optional brace. The first substantially tubular portion may engage the base by being affixed permanently or by use of a flange, allowing the base to be removed for easier transport and storage. The brace may be configured such that it secures the first substantially tubular portion perpendicularly to the base. The second tubular portion may be configured to engage a lower end of a vertical goal post. The second tubular portion may be hollow or solid. In one embodiment, the outer diameter of the second tubular portion may be slightly smaller than the inner diameter of the vertical goal post, creating a snug fit between the outer wall of the second tubular portion and the inner wall of the vertical goal post when the goal post is placed over the second tubular portion. In another embodiment, the inner diameter of the second tubular portion is slightly larger than the outer diameter of the vertical goal post creating a snug fit between the inner wall of the second tubular portion and the outer wall of the vertical goal post when the goal post is placed inside the second tubular portion. In this embodiment, the second tubular portion may include an opening to accommodate a goal base and netting when the vertical goal post is placed within the second tubular portion. Another embodiment engages the second end of the first substantial tubular portion with the upper horizontal goal crossbar using a suspension system so that the target is attached to the crossbar. In this embodiment, the target may be attached to the vertical goal post, may be in contact with the ice surface or may be allowed to swing free. Another embodiment accommodates an electronic scoring and/or sound system. In yet another embodiment, a third tubular portion if fitted over the first substantially tubular portion such that the third tubular portion moves freely along the outer surface of the first substantially tubular portion, allowing the player to adjust the position of the third tubular portion so that the player can practice shooting at a particular portion of the target and receive positive feedback when the area is hit. In another embodiment, sound damping spacers are placed between the different segments of the first substantial tubular sections to create different pitched sounds along its length so that the player and others know where the shot hit the target The substantially tubular portion may be hollow but need not be. In cross-section, the substantially tubular portion may be regular or irregular and may be, for example, round, oval, polygonal, hexagonal, octagonal, etc. The portion may change shape or size along the length of the portion or may be of constant shape and size (FIGS. 1, 2, 3A and 3B). The portion may vary in wall thickness along the length of the portion or the thickness may remain constant. The portion may be segmented into different materials with differing acoustical properties (FIGS. 1 and 2), exterior treatments or in any other manner including, but not limited to, the use of sound dampening spacers between the different segments (FIG. 11).

Figure 1:
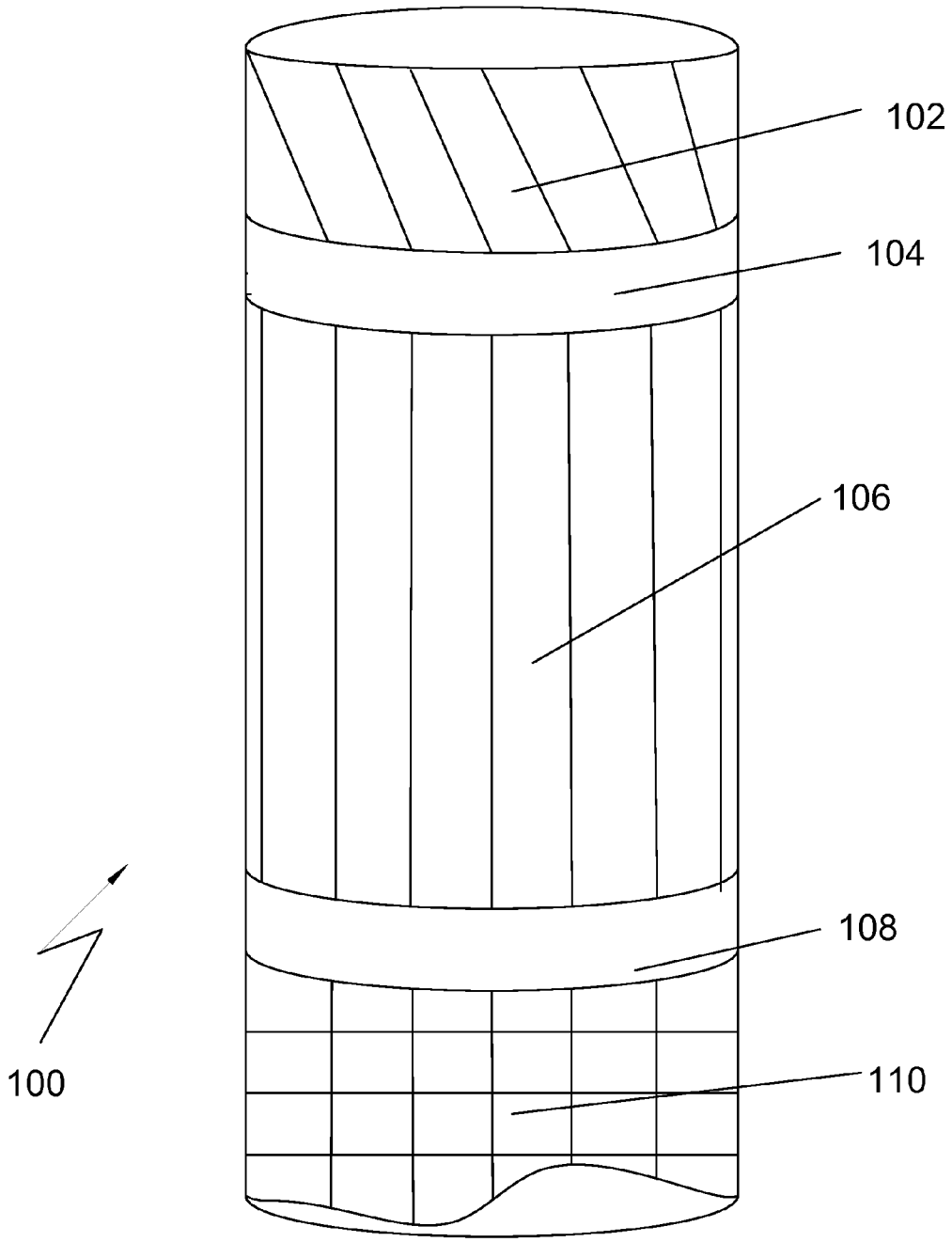
FIG. 1 provides a view of an embodiment of an ice hockey practice target comprising different sections constructed of different materials.
Figure 2:
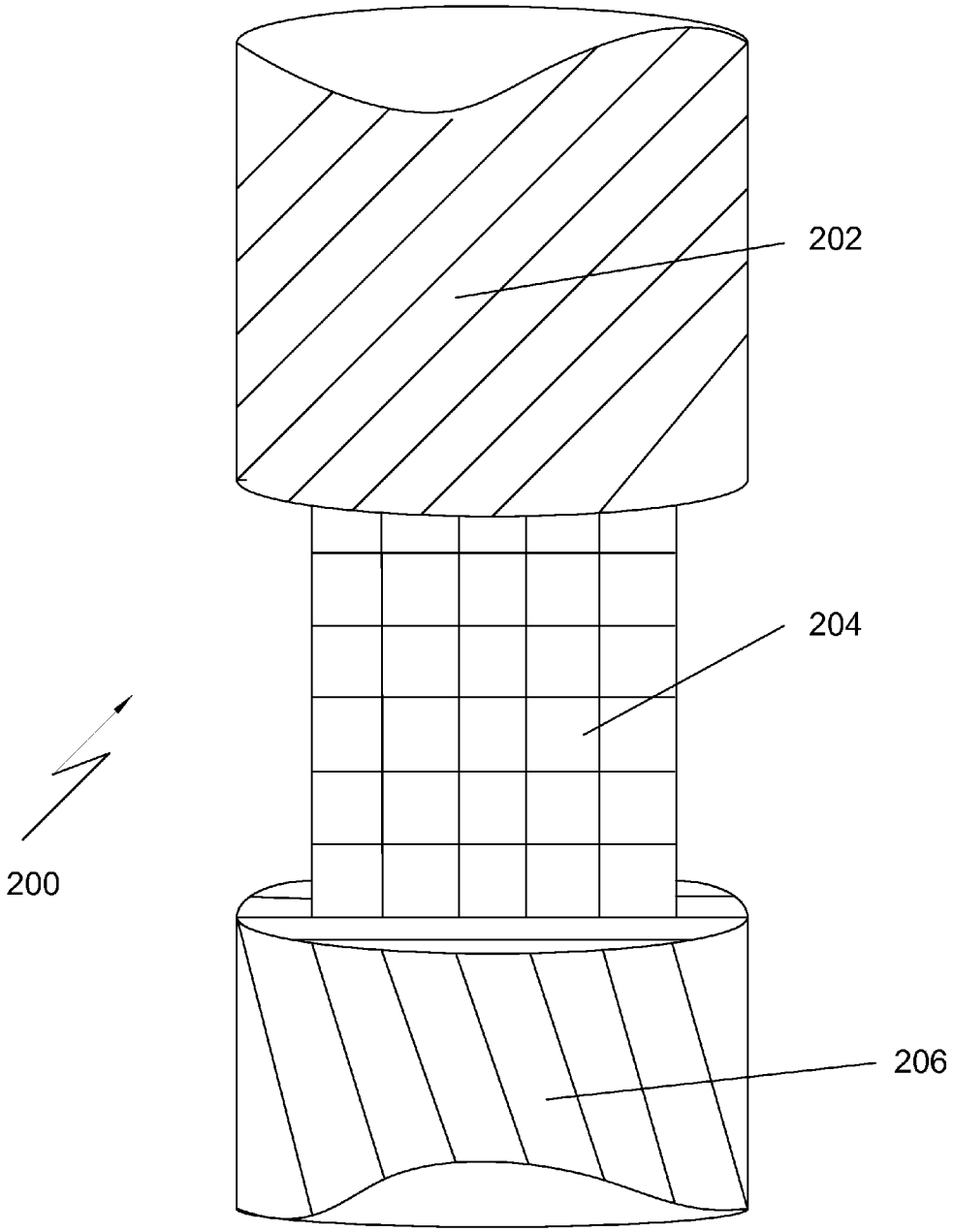
FIG. 2 provides a view of an embodiment of an ice hockey practice target comprising different shaped sections.
Figure 3B:
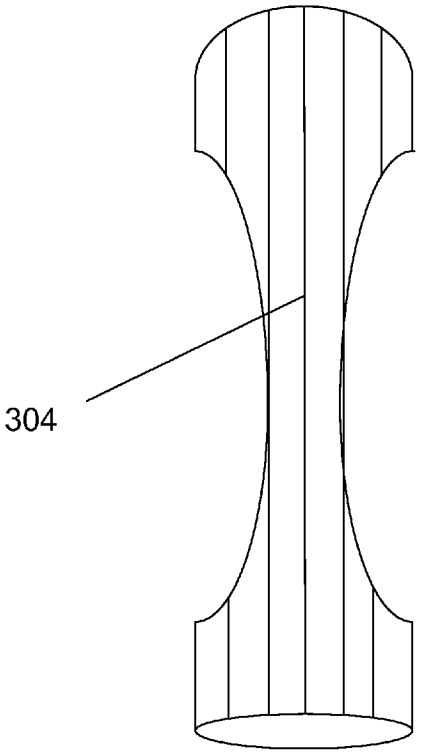
FIGS. 3A and 3B provide a view of an embodiment of an ice hockey target comprising a single segment.
Figure 3A:
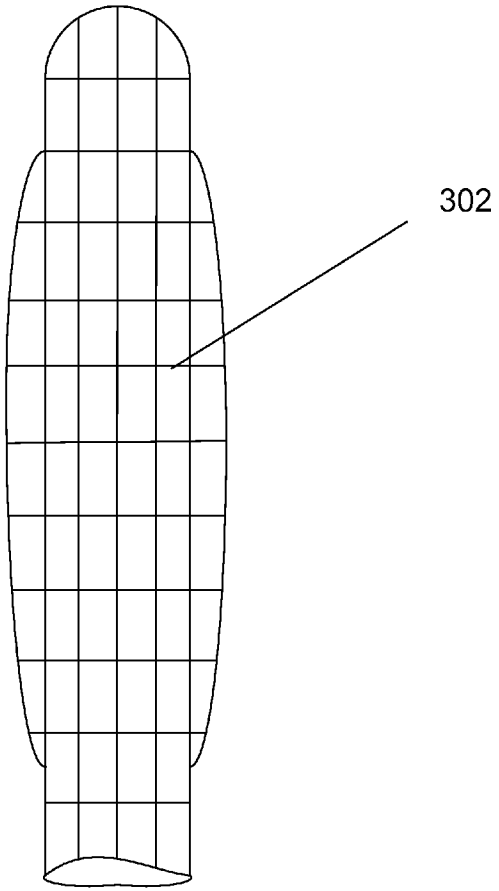
Figure 4B:
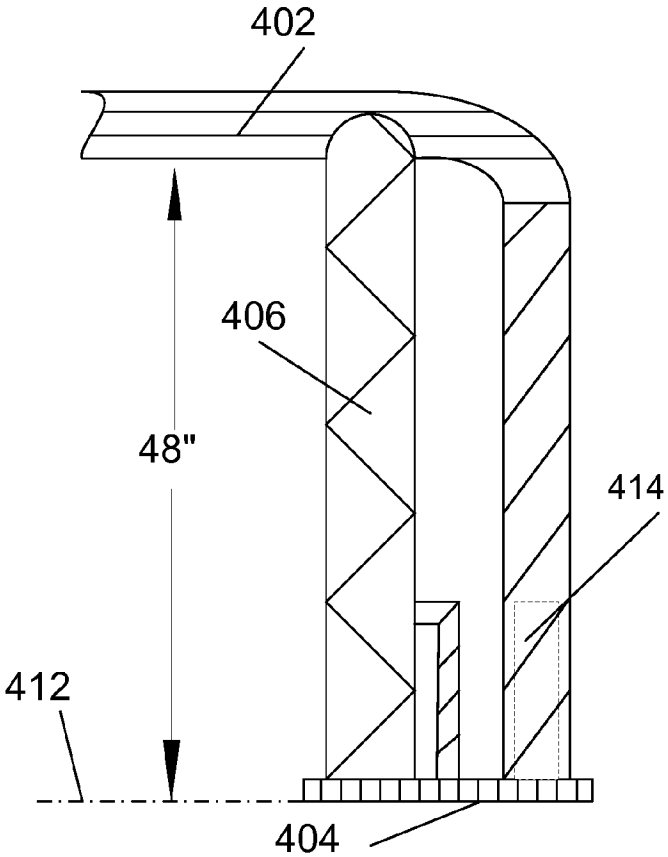
FIGS. 4A and B provide a frontal view of one embodiment of an ice hockey practice target, goal posts and crossbar.
Figure 4A:
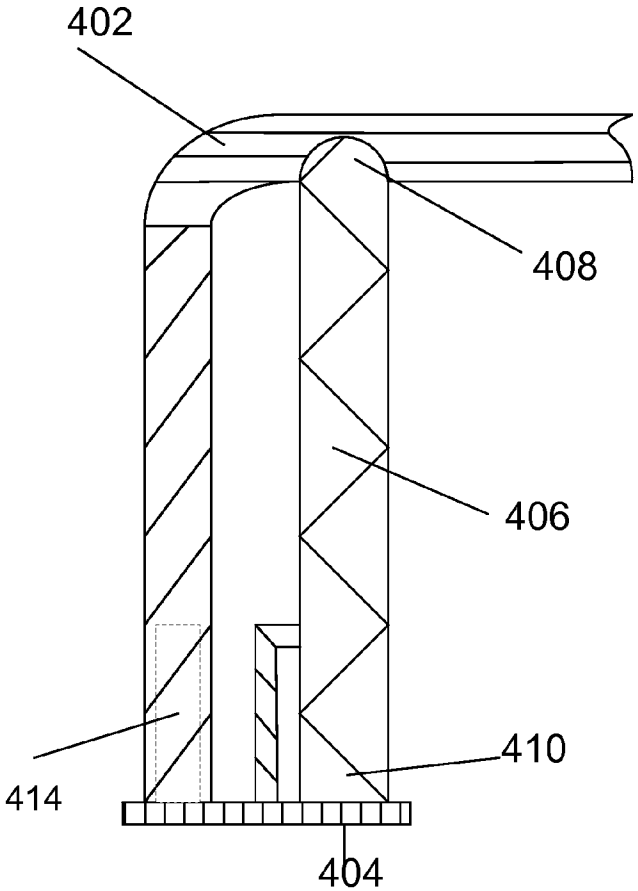
Figure 5:
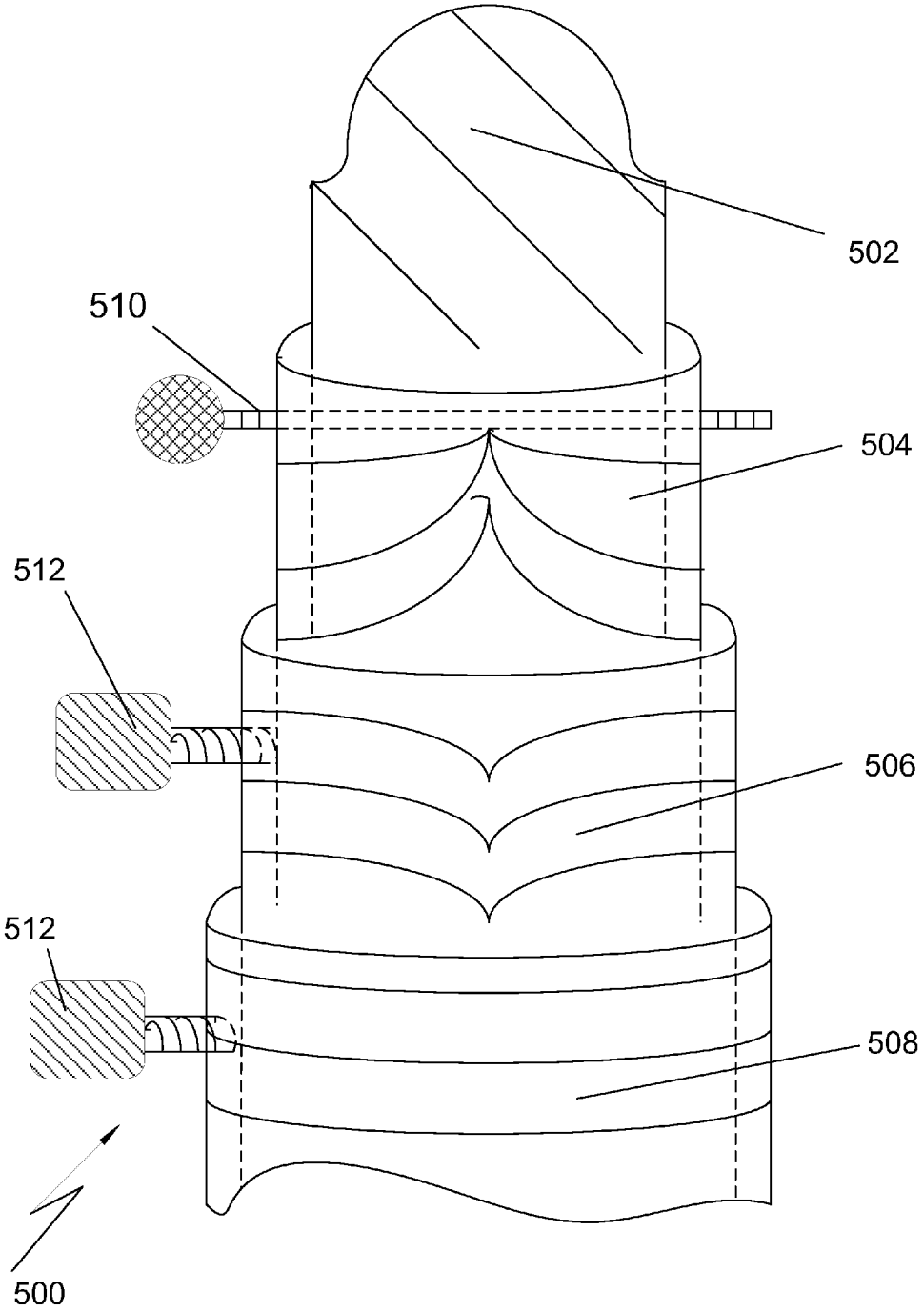
FIG. 5 provides a view of an embodiment of a telescoping ice hockey practice target.

As shown in the embodiment of FIGS. 4A and B, the target can be constructed to fit within the opening of the goal, the target comprising a first substantially tubular portion 406, with first end 410 fitted and attached to base 404 that rests on ice surface 412 and second end 408 constructed and arranged to receive upper horizontal goal crossbar 402. As shown in FIG. 4B, first substantially tubular piece 406 attached to base 404 fits snugly within the opening of an official hockey goal, which measures about 48" from ice surface 412 to the bottom of upper horizontal goal crossbar 402. The target can be sized so that it does not lift the goal from ice surface 412 but is not so short as to become unstable inside the goal opening. The target may be in compression between crossbar 402 and ice surface 412. First substantially tubular portion 406 may be made of metal tubing with an outer diameter between about 1" and 4", with a preferred outer diameter between about 2½" and 3". First substantially tubular portion 406 may also be constructed in multiple sections of different outer diameters so that it telescopes to facilitate easier transport and storage or to accommodate different goal heights (FIG. 5). In this embodiment, each section, 502, 504, and 506, can be secured in an extended position, for example, by a pin 510, a set screw 512, a cuff or a flange. In some embodiments, one or more portions, 504, 506, and 508, may include threaded or unthreaded holes therein for receiving pins or set screws.

In some embodiments, the first substantially tubular portion may be made out of materials of sufficient strength to withstand repeated hits from a hard projectile moving at a velocity in excess of about 50 mph. Materials include, for example, metals, polymers and/or alloys. These can include, but are not limited to, stainless steel, aluminum, steel, PVC, polycarbonate and fiberglass reinforced plastic. In many embodiments, the material provides an audible sound when the puck hits the first substantially tubular portion so that a player and others has notice that the shot has hit its target. The first substantially tubular portion can be solid or hollow. The first substantially tubular portion wall thickness can be varied to, for example, provide a different tone at different locations on the target or to facilitate easier use. A hollow construction may decrease the weight of the target, improve acoustics and facilitate easier handling. A specific sound can also be engineered by placing a second or even a third tube inside the first tubular portion. The diameter of the first substantially tubular portion may be such that a number of different diameter cylindrical horizontal crossbars can be seated across the top of the second end of the first substantially tubular portion. The exterior of the first substantially tubular portion may be painted, powder coated, rubber coated, treated with a weather resistant coating or treated by any other method suitable for protecting or improving the aesthetics of the material.

Figure 6A:
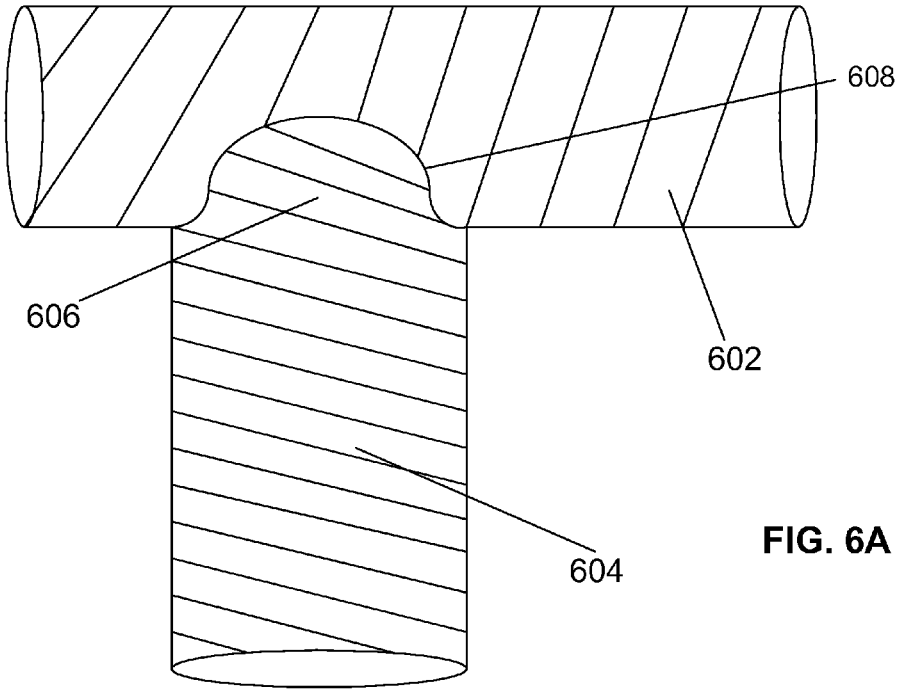
FIGS. 6A and 6B provide a plan view and a cross section view, respectively, of an upper end of the practice target of FIG. 4 which engages with an upper horizontal goal crossbar.
Figure 6B:
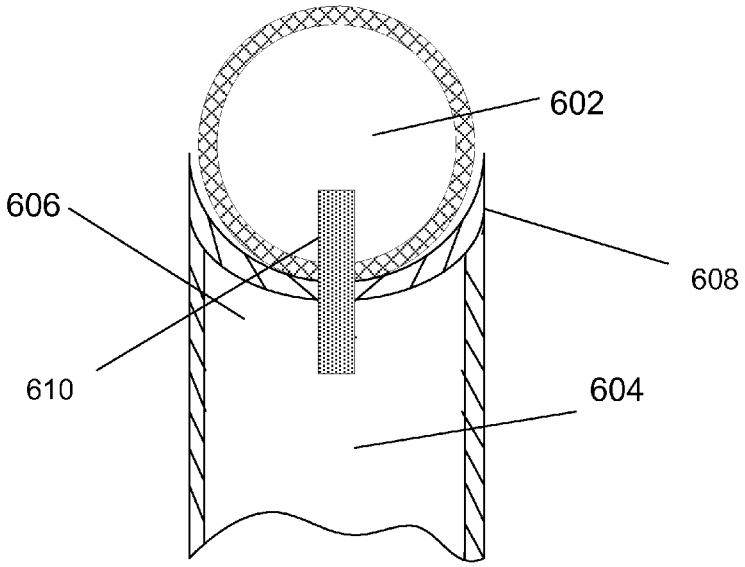
Figure 7:
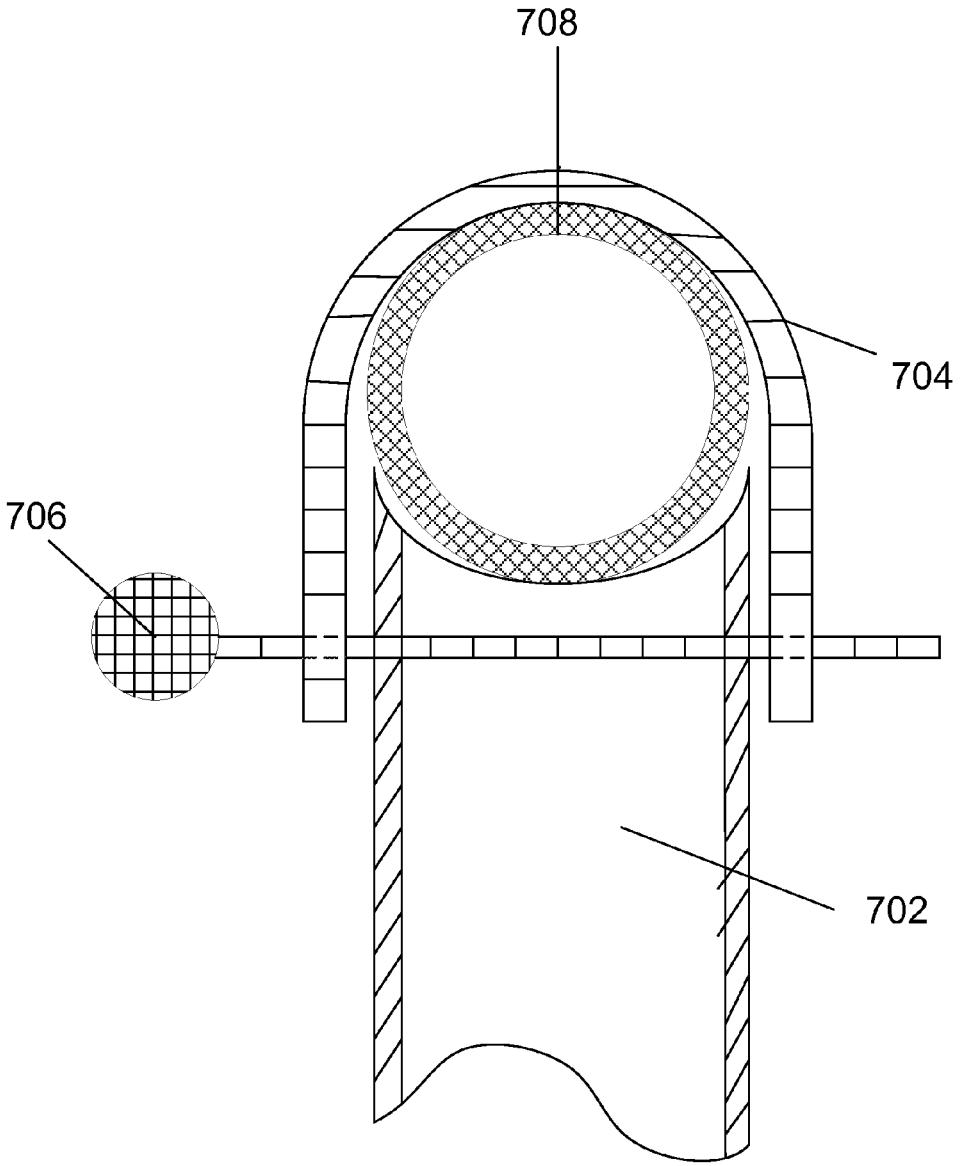
FIG. 7 provides a cross section view of the upper end of the practice target of FIG. 4 with a clamp securing the practice target to the upper horizontal goal cross bar.

As shown in the embodiment of FIGS. 6A and 6B, second end 606 of substantial tubular portion 604 may be yoke shaped so that an upper cylindrical horizontal crossbar 602 may fit into and be held in place by second end 606. Second end 606 may have an inner diameter of between about 2" and 4", with a preferred inner diameter between about 2½" and 3" (FIG. 6B). Second end 606 may be closed or open. An open second end 606 may permit the use of sand, foam water or like material inside first substantially tubular portion 604 to increase stability and to vary the pitch of the sound created in a filled portion compared to an empty portion of first substantially tubular portion 604. In one embodiment (FIG. 6B), yoke shaped cap 608 may be attached to second end 606. Cap 608 may be attached to second end 606 by welding, gluing, friction fit or by any other method suitable for attaching second end material to cap material. Pin 610 may be attached to the top of cap 606 so that crossbar 602 can be attached to second end 606, stabilizing second end 606 within the goal. Second end 606 and cap 608 may be coated with a protective material such as a rubberized material, plastic or any material adequate to protect upper horizontal goal crossbar 602 and second end 606. In another embodiment (FIG. 7), first substantially tubular portion 702 may be attached to upper horizontal goal crossbar 708, for example, by clamp 704 and pin 706, by hook and loop fastener, tape or any other suitable binding device.

In the embodiment of FIGS. 8A and 8B, base 800 of the target is fitted and attached to the first end of the first substantially tubular portion 802. Base 800 can be constructed of plate 808, supportive brace 806 and second tubular portion 804. First substantially tubular portion 802 and base 800 may be of similar or dissimilar materials. The exterior of base 800 may be finished in a similar manner to first substantially tubular portion 802. Base 800 may be attached to the first substantially tubular portion 802 by welding 810, gluing, friction fit or any other method suitable for attaching the first substantially tubular portion material to the base material. The connection may be permanent or temporary. Plate 808 can be constructed in such a way as to accommodate brace 806, second tubular portion 804 and first substantially tubular portion 802. Corners of plate 808 may be rounded so as not to extend beyond vertical goal post 812. Brace 806 may be constructed using a right angle configuration, connecting plate 808 to first substantially tubular portion 802 in a perpendicular configuration or any other configuration that provides vertical support to first substantially tubular portion 802 when target is in an upright position. Brace 806 may be fabricated of a material that can maintain the first substantially tubular portion's perpendicular position relative to the plate. Brace 806 may be attached to plate 808 by welding, gluing, or any other method suitable for attaching brace material to plate material. Second tubular portion 804 may be hollow so that a sleeve is formed into which a bottom end of vertical goal post 812 can be seated, second tubular portion 804 having an opening to accommodate a goal base and netting, or it may be solid or hollow so that the end of vertical goal post 812 fits over second tubular portion 804. In The base may be coated with a plastic or rubber to prevent damage to any skate blades that may come in contact.

In one embodiment (FIGS. 8A and 8B), the outer diameter of second tubular portion 804 may be slightly smaller, between about 1¾" and 2⅜", than the inner diameter of vertical goal post 812, creating a snug fit between the outer wall of second tubular portion 804 and the inner wall of vertical goal post 812 when the goal post is placed over second tubular portion 804. Second tubular portion 804 may be conical in shape to help guide vertical goal post 812 over second tubular portion 804. A threaded hole may be drilled through brace 806 through which set screw 816 can be threaded and tightened against vertical goal post 812, stabilizing vertical goal post 812 against second tubular portion 804. A wing nut 818 may be attached to the inside of brace 806 to further stabilize set screw 816. In another embodiment, the inner diameter of second tubular portion 804 is slightly larger than the outer diameter of vertical goal post 812, creating a snug fit between the inner wall of second tubular portion 804 and the outer wall of vertical goal post 812 when the goal post is placed inside second tubular portion 804. In this embodiment, second tubular portion 804 may include an opening to accommodate the goal base and netting when vertical goal post 812 is placed within second tubular portion 804. Second tubular portion 804 may be attached to the base by welding, gluing, or any other method suitable for attaching the second substantial tubular portion material to the plate material so that a tight and permanent joining is made. The cross section of second tubular portion 804 can take the same or different shape as first substantially tubular portion 802 and may be of sufficient diameter, between about 1" and 4" OD, to accommodate a variety of vertical goal posts.

Figure 9A:
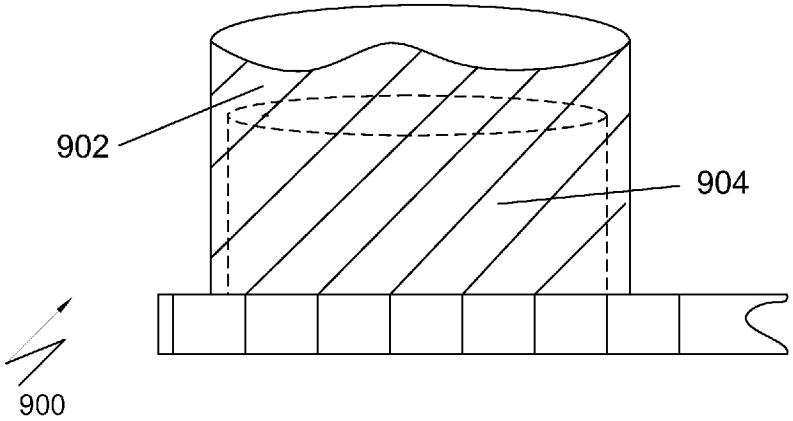
FIGS. 9A and 9B provide a view of an embodiment of a base of an ice hockey practice target comprising a flange with a first substantially tubular portion affixed.
Figure 9B:
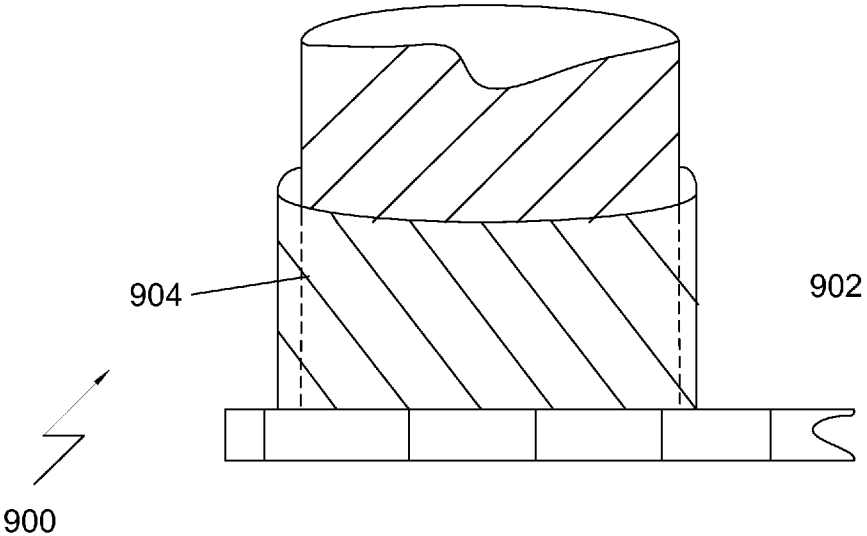

In the embodiment of FIG. 9A and 9B, first substantially tubular portion 902 may also be fitted to base 900 by fitting and attaching flange 904 to base 900 over which first substantially tubular portion 902 sits (FIG. 9A). First substantially tubular portion 902 may also seat in flange 904 (FIG. 9B). First substantially tubular portion 902 may be permanently attached to flange 904. First substantially tubular portion 902 may be removable from base 900 to facilitate ease of handling and transport. In this embodiment, the downward pressure exerted by the upper horizontal goal crossbar on first substantially tubular portion 902 and the upward pressure exerted by the ice surface on base 900 provide the needed vertical force to place the target in compression and stabilize first substantially tubular portion 902 and base 900 within the opening of the goal. In the embodiment of FIG. 9B, the outer diameter of first substantially tubular portion 902 may be slightly smaller than the inner diameter of flange 904, creating a snug fit between the outer wall of first substantially tubular portion 902 and the inner wall of flange 904 when first substantially tubular portion 902 is placed inside flange 904. In the embodiment FIG. 9A, the inner diameter of first substantially tubular portion 902 is slightly larger than the outer diameter of flange 904, creating a snug fit between the inner wall of first substantially tubular portion 902 and the outer wall flange 904 when first substantially tubular portion 902 is placed over flange 904.

Figure 10:
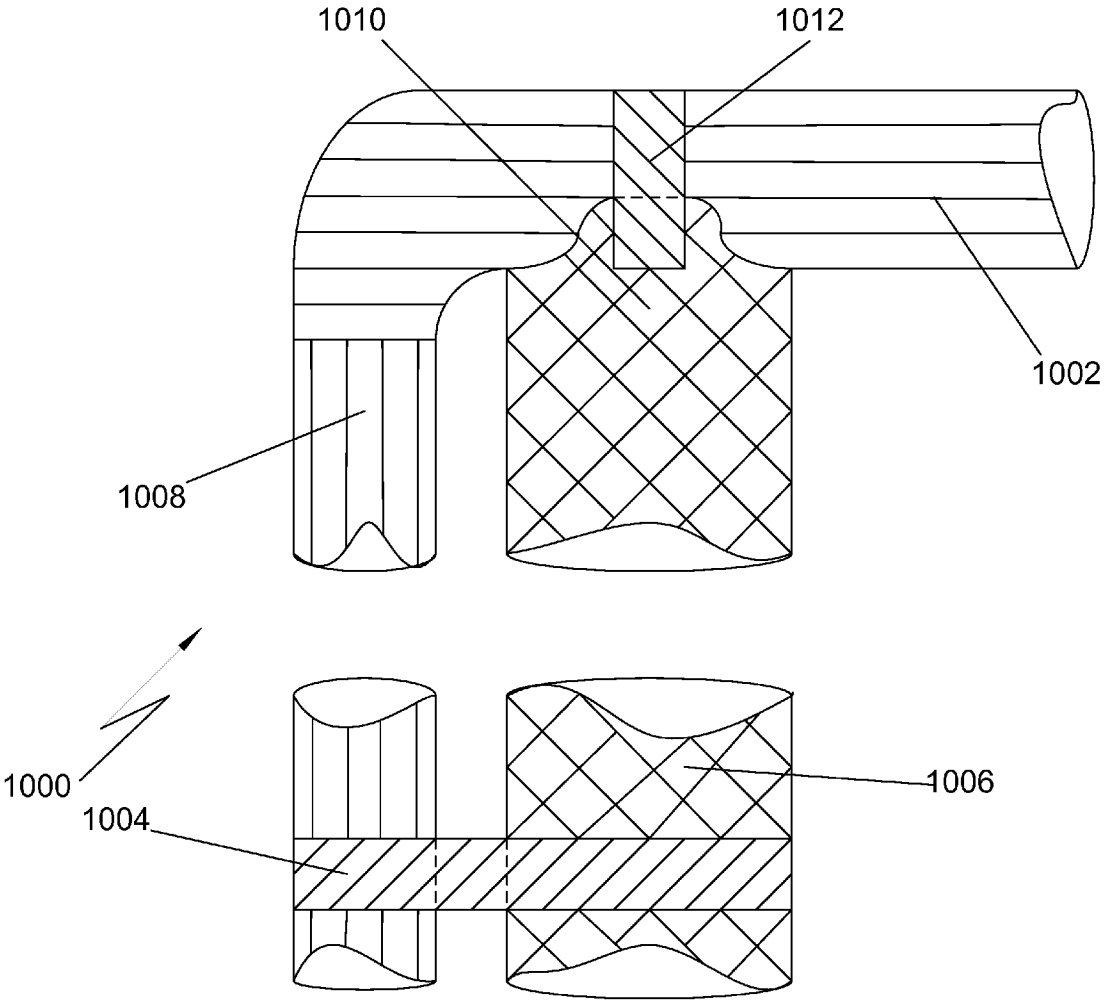
FIG. 10 provides a view of an embodiment of an ice hockey practice target that is suspended from an upper horizontal goal crossbar.

In FIG. 10, first substantially tubular portion 1006 may be suspended from upper horizontal goal crossbar 1002 by suspension system 1012. Suspension system 1012 can be made of hook and loop tape, rubber or any other type of binding device. First substantially tubular portion 1006 can be stabilized within the goal opening by attaching first substantially tubular portion 1006 to vertical goal post 1008 with fastener 1004 that can be, for example, a hook, clamp or binding. First substantially tubular portion 1006 may hang freely, without a base. In one embodiment, the base may be removable from first substantially tubular portion 1006. In another embodiment (FIG. 7), first substantially tubular portion 702 may be suspended from upper horizontal goal crossbar 708 by clamp 704 and pin 706.

Another embodiment is illustrated in FIG. 11 where a dampening band 1104 may be used to isolate the pitch of the sound generated by different areas of substantially tubular portion 1100 when hit, allowing the player and others to establish in which area the target was hit. Substantially tubular portion 1100 may be comprised of different segments, 1102 and 1106, further comprised of different materials. Dampening band 1104 may be made of rubber, plastic or any other material which has the required acoustical dampening characteristics. Segments 1102, 1106 and dampening band 1104 may be of different lengths and/or shapes. In one embodiment, segments 1102 and 1106 may be attached to dampening band 1104, for example, by use of pins 1108 or set screws. In one embodiment, dampening band 1104 may be constructed so that lower portion 1110 and upper portion 1112 may fit snugly within segments 1102 and 1106 and so that middle portion 1114 may have an outer diameter similar to segments 1102 and 1106. In some embodiments, dampening segment 1104 and segments 1102 and 1106 may include threaded or unthreaded holes therein to receive pins 1108 or set screws.

Figure 12:
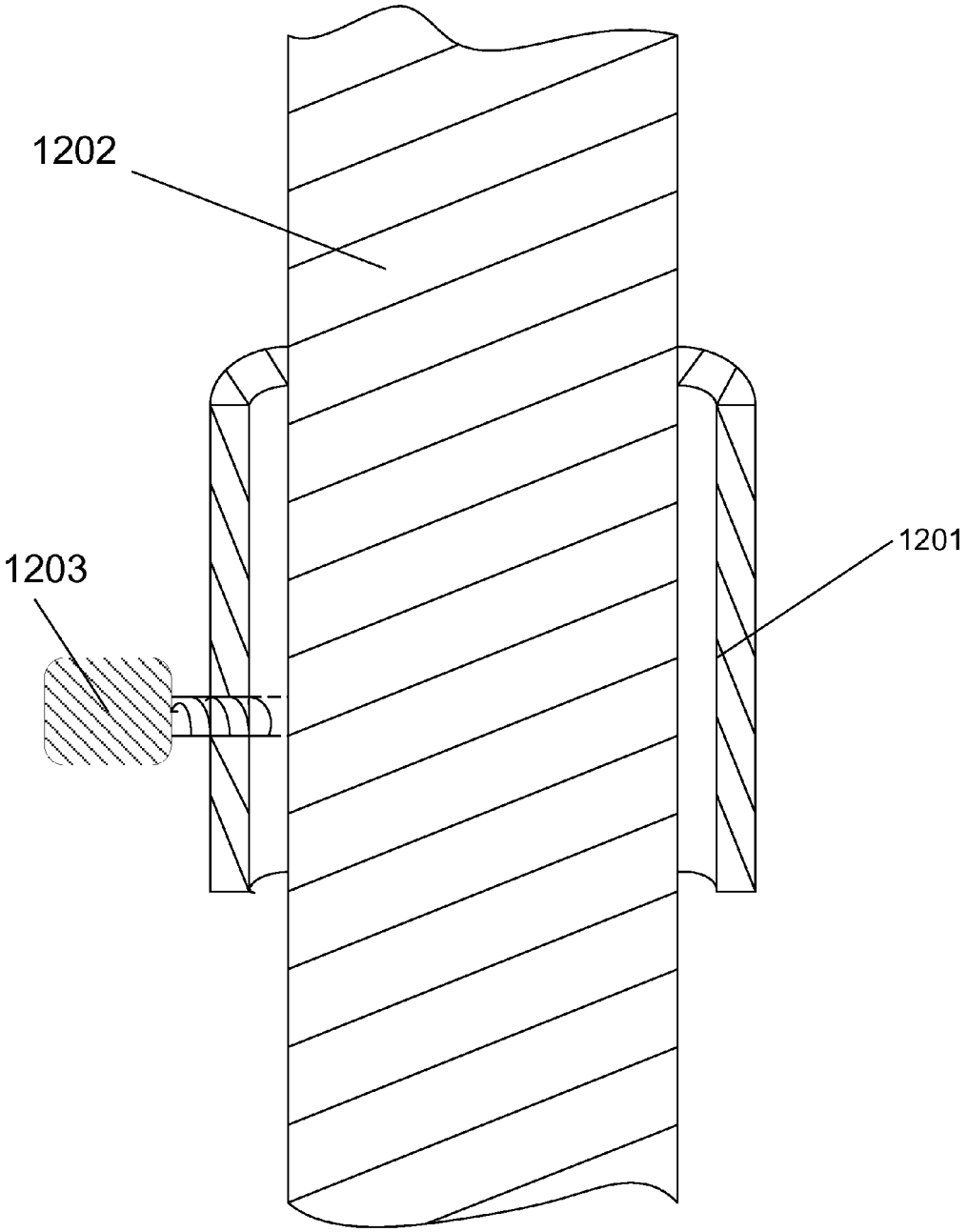
FIG. 12 provides a cross section view of an embodiment of an ice hockey practice target wherein a third tubular portion is fitted over a first substantially tubular portion.

In another embodiment, illustrated in FIG. 12, third tubular portion 1201 may be fitted over first substantially tubular portion 1202 to create a unique tone at a specific location along first substantially tubular portion 1202, giving notice to the player and observers that the puck hit the location. Third tubular portion 1201 may have an inner diameter between about 2⅜" to 3" so that third tubular portion 1201 can move freely along the outer surface of first substantially tubular portion 1202, allowing the player to practice shooting at a chosen location along the practice target. Third tubular portion 1201 may be composed of a material that produces a tone when struck by a projectile such as, for example, steel, aluminum, stainless steel, fiberglass reinforced plastic and polycarbonate. The length of third tubular portion 1201 may be determined by the skill of the player such that an advanced player is presented with a short target, for example between 6" to 12" long, while a novice player is presented with a long target, for example between 12" to 18" long. Third tubular portion 1201 may be secured in a desired location by, for example, at least one set screw 1203 or pin. Third tubular portion 1201 may include threaded or unthreaded holes therein to receive pins or set screws 1203.

In another embodiment, the target may be connected to an electronic device that records hits and provides an auditory as well as a visual indication that a player's shot was accurate. The target may be attached to the goal by any of the foregoing methods.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. An ice hockey practice target to be used in conjunction with an ice hockey goal on an ice surface, the ice hockey goal having a single horizontal crossbar connecting two goal posts, the practice target comprising:

a substantially planar base for contacting an ice surface;

a first substantially tubular portion comprising metal, the first substantially tubular portion including a first end attached to the base and a second end including an upwardly open yoke shaped cap constructed and arranged to receive the horizontal crossbar of the ice hockey goal that is 48 inches off the ice surface; and a second tubular portion attached to the base, the second tubular portion parallel to the first substantially tubular portion, shorter than the first substantially tubular portion and having an outer diameter that is less than the inner diameter of the ice hockey goal post and less than the outer diameter of the first substantially tubular portion, the second tubular portion constructed and arranged to slide inside the vertical goal post of the ice hockey goal to secure the practice target to the ice hockey goal.

2. The ice hockey practice target of claim 1 further comprising a clamp to secure the first substantially tubular portion to the upper horizontal goal crossbar.

3. The ice hockey practice target of claim 1 wherein the base comprises a planar plate configured to accommodate the first substantially tubular portion and the second tubular portion.

4. The ice hockey practice target of claim 1 wherein an outer diameter of the first substantially tubular portion is between about 1 inch and about 4 inches.

5. The ice hockey practice target of claim 1 wherein an inner diameter of the second end of the first substantially tubular portion is between about 2⅜ inches and about 3 inches.

6. The ice hockey practice target of claim 1 wherein the first substantially tubular portion is comprised of a material that produces a tone when struck, the material selected from a group consisting of steel, aluminum and stainless steel.

7. The ice hockey practice target of claim 1 wherein the first substantially tubular portion is of a continuous outer diameter.

8. The ice hockey practice target of claim 1 wherein the first substantially tubular portion varies in outer diameter along its length.

9. The ice hockey practice target of claim 1 wherein the first substantially tubular portion comprises a wall of varying thickness along its length.

10. The ice hockey practice target of claim 1 wherein the first substantially tubular portion produces as least two distinct tones when struck by a projectile at different locations on the substantially tubular portion.

11. The ice hockey practice target of claim 1 wherein the first substantially tubular portion comprises at least two different segments.

12. The ice hockey practice target of claim 11 wherein the different segments are graduated in diameter and are nested to allow for telescoping of the segments.

13. The ice hockey practice target of claim 11 wherein at least one segment is a dampening band that acoustically isolates two additional segments.

14. The ice hockey practice target of claim 1 wherein the first substantially tubular portion is attached to the base by a flange.

15. An ice hockey practice target comprising:

an ice hockey goal including a crossbar and two goal posts defining a hockey goal opening;

a base constructed and arranged to sit on an ice surface;

a first substantially tubular portion comprising a first end and a second end;

a first end of the first substantially tubular portion constructed and arranged to attach to the base so that the base stabilizes the first end at about a ninety degree angle relative to the ice surface and vertically within a hockey goal opening; and a second end of the first substantially tubular portion including an upwardly open yoke shaped cap, the upwardly open yoke shaped cap temporarily engaged with the crossbar so that the crossbar stabilizes the second end at about a ninety degree angle relative to the crossbar and vertically within the hockey goal opening.

* * * * *